US005552188A

United States Patent [19]

Suzuki et al.

[11] Patent Number: 5,552,188

[45] Date of Patent: Sep. 3, 1996

[54] METHOD AND APPARATUS FOR HIGH SPEED, THIN LAYER COATING

[75] Inventors: Yoshinori Suzuki; Tadahiro Tsujimoto; Satoru Fujisaki, all of Kanagawa, Japan

[73] Assignee: Fuji Photo Film Co., Ltd., Kanagawa, Japan

[21] Appl. No.: 487,518

[22] Filed: Jun. 7, 1995

[30] Foreign Application Priority Data

Jun. 8, 1994 [JP] Japan ..... 6-126477

[51] Int. Cl.[6] ..... B05D 1/26; B05C 5/02

[52] U.S. Cl. ..... 427/402; 427/420; 118/410; 118/411

[58] Field of Search ..... 118/410, 411, 118/DIG. 4; 427/402, 420

[56] References Cited

U.S. PATENT DOCUMENTS

| | | | |
|---|---|---|---|
| 4,292,349 | 9/1981 | Ishiwata et al. | 427/335 |
| 4,313,980 | 2/1982 | Willemsens | 427/402 |
| 5,119,757 | 6/1992 | Chino et al. | 118/410 |
| 5,275,660 | 1/1994 | Ozaki et al. | 118/411 |

FOREIGN PATENT DOCUMENTS

| | | |
|---|---|---|
| 0361167 | 4/1990 | European Pat. Off. . |
| 826977 | 7/1949 | Germany . |
| 3636815 | 5/1987 | Germany . |
| 62-53768 | 3/1987 | Japan . |
| 62-227464 | 10/1987 | Japan . |

OTHER PUBLICATIONS

Research Disclosure, 16944 (May, 1978).

Derwent Publications Ltd., London, GB, JP-A-63 060 255, Mar. 16, 1988 (Abstract).

*Primary Examiner*—Katherine Bareford

*Attorney, Agent, or Firm*—Sughrue, Mion, Zinn, Macpeak & Seas

[57] ABSTRACT

An apparatus for bead coating a substrate with an organic solvent-based coating solution by the use of a slide hopper is disclosed, which is useful for preventing deflection of the members due to changes in temperature stemming from evaporation of the organic solvent and for maintaining a narrowed gap between the lip of the hopper and the substrate with high precision, in which the slide hopper is composed of a raw material with a coefficient of linear expansion of $3\times10^{-6}$ or less, or composed of an alloy comprising 9.0% to 10.5% by weight of chromium, 52.5% to 56.0% by weight of cobalt and the remainder consisting of iron and other inevitable impurities.

4 Claims, 1 Drawing Sheet

METHOD AND APPARATUS FOR HIGH SPEED, THIN LAYER COATING

FIELD OF THE INVENTION

The present invention relates to an apparatus for bead coating a substrate such as a web with an organic solvent-based coating solution by the use of a slide hopper, and particularly to a technique for forming a thin layer by stable, high-speed coating.

BACKGROUND OF THE INVENTION

Coating by the use of the slide hopper, which is usually useful for forming a thin layer, is widely used to manufacture photographic materials. Since the photographic material generally has a structure composed of 10 or more layers within a total thickness of tens μm, the slightest change in coating thickness of each layer has a large effect on quality of the photographic material so that control of the coating thickness is very important.

In recent years, formation of a thinner layer has been increasingly expected. In order to attain stable, high-speed coating with an organic solvent by the use of the slide hopper to form a thin layer, the gap between a lip of the hopper and the web has to be narrowed and maintained with high precision.

For example, when a coating solution containing acetone and methanol as main components is applied by the use of a slide hopper with a coating width of 1 m, even if the lip has been set in parallel with the backing roller prior to feed of the coating solution, evaporation of the coating solution reduces temperatures of the members such as the slide surface on feeding the coating solution, causing the whole hopper to be concaved in relation to the backing roller. As a result, the gap between the lip and the backing roller may change by as much as about 40 μm. Since the gap is usually set within the range of 50 to 300 μm, the changes up to 40 μm have an important effect on coating properties under thin-layer coating conditions where narrowed and precise setting of the gap is particularly required.

Thus, in the coating by the use of the slide hopper, a major cause of fluctuations in-coating thickness consists in fluctuations in the gap between the lip and a substrate to be coated. The reason for the fluctuations in the gap between the lip and the substrate is that the coating with an organic solvent-based coating solution is accompanied by the evaporation of the organic solvent when the coating solution flows through the slide surface of the slide hopper, and therefore, that the heat of evaporation partially reduces the temperature of the lip, causing contraction thereof.

As one of the conventional techniques to prevent such heat contraction of the slide hopper, use of coating apparatus made of ceramics is described in U.S. Pat. No. 5,275,660 (corresponding to JP-A-2-71869, The term "JP-A" as used herein means an "unexamined published Japanese patent application"). This technique helps to reduce the heat contraction of the hopper because of smaller coefficients of linear expansion of the ceramics, compared to stainless steel which is widely used as a raw material for the hopper.

It is further described in U.S. Pat. No. 4,292,349 (corresponding to JP-A-55-75758) that the coating section is provided with a cover to form an airtight region therein.

Furthermore, JP-A-62-53768 proposes to extremely reduce a length of the slide surface (a distance from an outlet for the coating solution to the lip) to from 0.1 to 10 mm to prevent the evaporation of the organic solvent flowing through the slide surface. This helps to prevent the fluctuations in coating thickness stemming from a flow of the coating solution depending upon non-uniform surface tension developed between the slit and the lip by the evaporation of the organic solvent flowing through the slide surface and from changes in physical properties of the flowing coating solution such as viscosity in the thickness direction.

However, these conventional techniques described above have the following disadvantages, respectively.

The technique described in U.S. Pat. No. 5,275,660 has difficulty in cutting the ceramics because of extremely large hardness thereof. The ceramics are only cut by a few μm in a single operation so that the cutting work requires much time. Some problems such as breakage in cutting tools and cracking in the raw materials may further be encountered.

In the technique described in U.S. Pat. No. 4,292,349, it is impossible to keep the coating section completely airtight. Particularly, movement of a substrate in the vicinity of the bead disturbs the airtightness within the hopper. This makes it impossible to completely prevent the evaporation of the organic solvent flowing through the slide surface so that contraction causes the lip to be deformed, failing to form a thin layer with high precision.

The technique described in JP-A-62-53768 also helps to prevent the evaporation of the organic solvent flowing through the slide surface. However, a shortened length of the slide surface causes insufficient flowing speed of the coating solution so that some types of coating solutions may not be applied. This technique therefore lacks flexibility in use. Further, a reduction in cross-sectional area of the hopper due to the shortened slide surface lowers stiffness to the deflection stemming from changes in temperature, which makes it difficult to maintain the gap between the lip and the web with high precision.

Corrosion of the lip also causes the fluctuations in coating thickness. The reasons for the corrosion are that the coating solution may possibly contain a liquid extremely low in pH or a corrosive substance and that a strongly corrosive liquid may be inevitably used for washing the coating apparatus.

Further, heat generated by working each block of the hopper causes distortion. Use of raw materials with relatively large coefficients of linear expansion may possibly result in reduction in working precision to an extent that the precision itself cannot be neglected.

SUMMARY OF THE INVENTION

An object of the present invention is to provide a coating apparatus capable of preventing deflection of the slide hopper owing to changes in temperature brought about by coating with an organic solvent and of maintaining a narrowed gap between the lip and the web with high precision.

The object of the present invention has been accomplished by the following means:

(1) An apparatus for bead coating a substrate with an organic solvent-based coating solution by the use of a slide hopper, wherein the slide hopper is composed of a raw material with a coefficient of linear expansion of $3\times10^{-6}$/°C. or less.

(2) An apparatus for bead coating a substrate with an organic solvent-based coating solution by the use of a slide hopper, wherein the slide hopper is composed of an alloy comprising 9.0% to 10.5% by weight of chromium, 52.5% to 56.0% by weight of cobalt and the remainder consisting of iron and other inevitable impurities.

(3) A method of bead coating a substrate with a coating solution through the coating apparatus described in above (1) or (2), wherein the coating solution comprises a component having a boiling point of 80° C. or less as a main component.

DETAILED DESCRIPTION OF THE INVENTION

Figure 1:
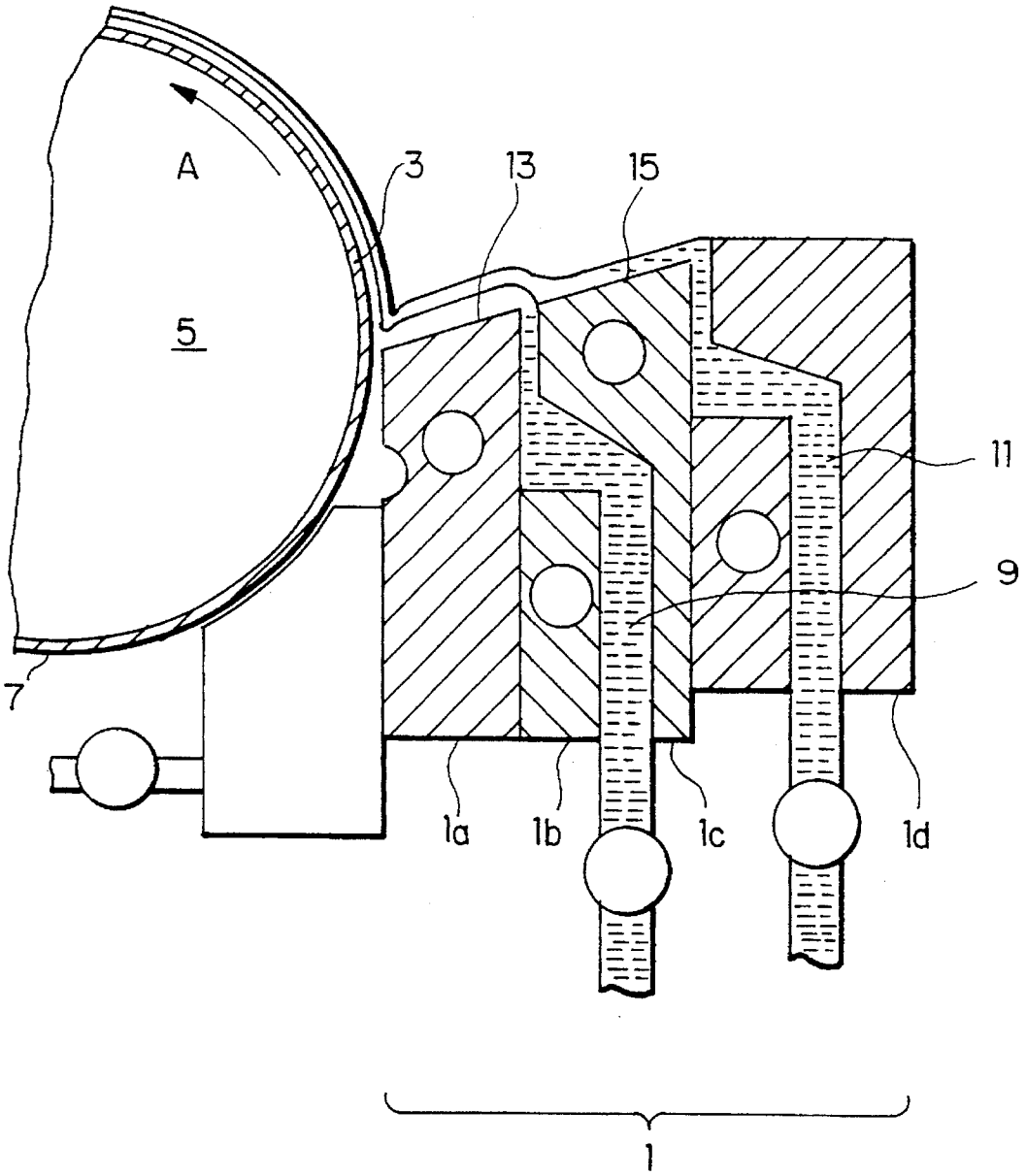
FIG. 1 is a cross sectional view of a main portion of the coating apparatus of the present invention.

When a low-boiling solvent contained in an organic solvent-based coating solution evaporates from a slide surface, a slide hopper with a coefficient of linear expansion of $3\times10^{-6}$ or less can avoid deformation which may have an adverse effect on coating. Stable, high-speed coating to form a thin layer is therefore possible. The above-mentioned U.S. Pat. No. 5,275,660 discloses slide hoppers made of ceramics with coefficients of linear expansion of $11\times10^{-6}$ or less. However, in slide hoppers made of alloys with the same coefficients of linear expansion, $11\times10^{-6}$ or less, the lips deforms, resulting in the fluctuations in coating thickness. In slide hoppers made of alloys with coefficients of linear expansion of $3\times10^{-6}$ or less, as described in the present invention, the lips do not deform enabling to form a thin layer by high-speed coating.

Slide hoppers with an extremely low coefficient of linear expansion, $3\times10^{-6}$ or less, can be produced when the raw materials thereof are alloys having the above-mentioned composition. Further, such alloys can be more easily worked, compared to stainless steel or ceramics.

This makes it possible to maintain an uniform gap between the lip and the web in the crosswise direction so that the gap can be set to a smaller value. Stable coating is therefore possible, so that the lowest coating amount of a coating solution can be more reduced.

In the present invention, determination of the coefficient of linear expansion as described above has been conducted by the following reasons.

As a result of various experiments, the present inventors have discovered that, although raw materials with a coefficient of linear expansion of about $11\times10^{-6}$ do not cause so large heat contraction, slide hoppers composed of the raw materials with this degree of coefficient of linear expansion are not sufficient for forming a thin layer by high-speed coating, and that raw materials with a coefficient of linear expansion of $3\times10^{-6}$ or less are required for preventing changes in the gap between the lip and the web generated by forming a thin layer by high-speed coating.

In the present invention, determination of the composition of alloy as described above has been conducted by the following reasons.

Cr: from 9.0% to 10.5% by weight:

A chromium content below 9.0% by weight deteriorates resistance of the resulting alloy to corrosion, whereas a chromium content exceeding 10.5% by weight increases the coefficient of linear expansion.

Co: from 52.5% to 56.0% by weight:

A cobalt content below 52.5% by weight reduces the coefficient of linear expansion, but deteriorates the resistance to corrosion. A cobalt content exceeding 56.0% by weight improves the resistance to corrosion, but increases the coefficient of linear expansion to exceed the upper limit thereof.

In the present invention, solvents usable for forming a thin layer by stable, high-speed coating are organic volatile solvents such as acetone, methanol, methylene chloride, ethanol, methyl ethyl ketone, ethyl acetate, methyl acetate, xylene, toluene, cyclohexane, cyclohexanone, propanol, and butanol.

Although the present invention is useful for organic solvent-based coating solutions, a mixture of water and an organic solvent can also be suitably used for a coating solution in the invention to solve the same problems as described above which the mixture also encounters, when the organic solvent is a main component of the mixtures.

Further, the present invention also is available for a water-based coating solution with which is coated at a higher temperature. The water-based coating solution still evaporates from the slide surface at high-temperature coating, which generally causes the heat contraction to deform the lip. However, the present invention can prevent the deformation of the lip stemming from evaporation of the water-based coating solution.

In the present invention, the distance between the lip of the slide surface and the surface of a substrate conveyed on the backing roller, ranges from 10 to 400 μm, preferably from 30 to 250 μm, and more preferably from 50 to 180 μm. Particularly, for precise coating to form a thin layer, a preferred gap between the lip and the substrate ranges from 50 to 100 μm.

Coating through the coating apparatus of the present invention is preferably conducted at ambient temperatures adjusted to about 15° to about 30° C.

The coating speed, viscosity of coating solution, coating width, coating solution, and substrate used in the present invention are known ones, respectively. The present invention is suitable, for example, for coating a substrate formed of cellulose triacetate to form an undercoat layer.

Further, the present invention can be applied to known apparatus and method of coating, preferably as described in U.S. Pat. No. 3,993,019, JP-B-51-39980 (The term "JP-B" as used herein means an "examined Japanese patent publication) and JP-B-5-71309, as long as the effect of the present invention is not lost.

EXAMPLES 1 AND 2 AND COMPARATIVE EXAMPLES 1 TO 4

A coating solution with the composition given below was applied through the coating apparatus shown in FIG. 1 under the conditions given below. FIG. 1 shows a cross sectional view of a multislide hopper used for coating a cellulose triacetate substrate to form an undercoat layer.

Blocks 1*a* to 1*d* constituting slide hopper 1 each are set so as to have a specified gap between lip 3 and substrate 7 on backing roller 5. Coating solutions 9 and 11 supplied from slide hopper 1 flow through slide surfaces 13 and 15, respectively, and are applied while forming beads between lip 3 and substrate 7 moving around backing roller 5 rotating in the direction shown by arrow A.

In order to examine how coating properties depend upon the coefficient of linear expansion of alloy, slide hoppers were produced from the alloys shown in Table 1.

| Composition of Coating Solution: | |
|---|---|
| Acetone | 50% (volume ratio) |
| Methanol | 20% (volume ratio) |
| Methylene chloride | 30% (volume ratio) |
| Solid Materials (based on the above mixed solvent) | |
| Gelatin | 1% by weight |
| Formaldehyde | 0.1% by weight |
| Salicylic Acid | 0.01% by weight |
| **Coating Conditions:** | |
| Coating Speed | 50 m/min |
| Coating Width | 2 m |
| Temperature of Coating Solution at the Inlet of the Hopper | 25° C. |
| Temperature of Water Passing through the Hopper | 25° C. |
| Gap between the Lip and the Substrate (before beginning coating) | 100 μm |
| Substrate | cellulose triacetate |

lip and the blocks excluding the slide surfaces was 2° C. in all of Examples 1 and 2 and Comparative Examples 1 to 4.

This shows that, when the raw materials with a coefficient of linear expansion of $3\times10^{-6}$ or less are used for the slide hoppers, the lips deformed little to form a thin layer even by high-speed coating.

EXAMPLES 3 TO 5 AND COMPARATIVE EXAMPLES 5 TO 15

The resistance to corrosion and coefficient of linear expansion of the raw materials were examined under the conditions given below. Results are shown in Table 2.

Evaluation of Resistance to Corrosion:

Samples to be tested were placed in a liquid having the following composition so as to intersect the vapor-liquid interface, and allowed to stand at room temperature (20° to 25° C.) for 6 months to examine the corrosion of the samples.

TABLE 1

| | Raw Material | Composition (% by weight) | Coefficient of Linear Expansion | The Lowest Coating Amount (ml/m$^2$) | Deflection of Lip (μm) |
|---|---|---|---|---|---|
| Example | | | | | |
| 1 | Alloy 1 | Cr 9.3, Co 53.6, Fe | $0.6\times10^{-6}$ | 11 | 5 |
| 2 | Alloy 3 | Cr 9.6, Co 52.7, Fe | $2.8\times10^{-6}$ | 11 | 5 |
| Comparative Example | | | | | |
| 1 | Alloy 7 | Cr 10.7, Co 54.5, Fe | $4.3\times10^{-6}$ | 17 | 15 |
| 2 | Alloy 12 | Ni 38, Co 15, Fe | $7.7\times10^{-6}$ | 19 | 20 |
| 3 | Alloy 10 | Ni 38.9, Cr 1.4, Co 7.6, Fe | $9.1\times10^{-6}$ | 20 | 30 |
| 4 | SUS630 | Cr 17, Ni 4, Cu 4, Fe | $12.0\times10^{-6}$ | 20 | 30 |

As shown in Table 1, high-speed coating in a lower coating amount, 11 ml/m$^2$, could be achieved in Examples 1 and 2, whereas it was difficult to attain a coating thickness not exceeding 17 ml/m$^2$ by high-speed coating in Comparative Examples 1 to 4.

After an elapse of 30 min after coating started (coating amount: 25 ml/m$^2$), measured deviations from straightness of the lip was 5 μm in Examples 1 and 2 and 15 to 30 μm in Comparative Examples 1 to 4. Incidentally, after the coating finished, the difference in temperature between the Composition of Liquid Used for Evaluating:

| | |
|---|---|
| Acetone | 50% (volume ratio) |
| Methanol | 20% (volume ratio) |
| Methylene Chloride | 30% (volume ratio) |
| Gelatin | 1% by weight |
| Formaldehyde | 0.1% by weight |
| Salicylic Acid | 0.01% by weight |

When the above-mentioned solution was extracted with 20-fold pure water (in volume), the aqueous liquid was of pH 3.1.

TABLE 2

| | Raw Material | Composition (% by weight) | Coefficient of Linear Expansion | Resistance to Corrosion | Total Evaluation |
|---|---|---|---|---|---|
| Example | | | | | |
| 3 | Alloy 1 | Cr 9.3, Co 53.6, Fe | $0.6\times10^{-6}$ | o | o |
| 4 | Alloy 2 | Cr 9.5, Co 53.8, Fe | $1.1\times10^{-6}$ | o | o |
| 5 | Alloy 3 | Cr 9.6, Co 52.7, Fe | $2.8\times10^{-6}$ | o | o |
| Comparative Example | | | | | |
| 5 | Alloy 4 | Cr 9.3, Co 56.5, Fe | $3.5\times10^{-6}$ | o | x |
| 6 | Alloy 5 | Cr 9.5, Co 52.0, Fe | $7.5\times10^{-6}$ | x | x |
| 7 | Alloy 6 | Cr 8.8, Co 55.0, Fe | $4.5\times10^{-6}$ | x | x |
| 8 | Alloy 7 | Cr 10.7, Co 54.5, Fe | $4.3\times10^{-6}$ | o | x |

TABLE 2-continued

| | Raw Material | Composition (% by weight) | Coefficient of Linear Expansion | Resistance to Corrosion | Total Evaluation |
|---|---|---|---|---|---|
| 9 | Alloy 8 | Cr 11.3, Co 55.1, Fe | $12.8 \times 10^{-6}$ | o | x |
| 10 | Alloy 9 | Ni 19.1, Cr 7.1, Co 24.5, Fe | $4.1 \times 10^{-6}$ | x | x |
| 11 | Alloy 10 | Ni 38.9, Cr 1.4, Co 7.6, Fe | $9.1 \times 10^{-6}$ | x | x |
| 12 | Alloy 11 | Ni 32, Co 5, Fe | $0.4 \times 10^{-6}$ | x | x |
| 13 | Alloy 12 | Ni 38, Co 15, Fe | $7.7 \times 10^{-6}$ | x | x |
| 14 | Zirconia | $ZrO_2$ | $11.0 \times 10^{-6}$ | x | x |
| 15 | SUS 630 | Cr 17, Ni 4, Cu 4, Fe | $12.0 \times 10^{-6}$ | o | x |

Underlined components in the column of the composition shown in Table 2 have ratios different from those restricted by the present invention. As a result, Table 2 shows that the raw materials with compositions which are out of the permitted ranges restricted by the present invention fail to fully satisfy both the resistance to corrosion and coefficient of linear expansion.

In Example 3, the slide hopper composed of alloy 1 with a composition of Cr 9.3%, Co 53.6% and Fe has excellent resistance to corrosion and a coefficient of linear expansion of $0.6\times10^{-6}$ which is within the permitted range. Therefore, the lip does not deform enabling to form a thin layer by high-speed coating. Although alloys 2 and 3 used in Examples 4 and 5 have larger coefficients of linear expansion than the alloy of Example 3, those values themselves are within the permitted range, respectively. The lips formed of these alloys therefore do not deform enabling to form a thin layer by high-speed coating.

On the contrary, in Comparative Example 6, although the chromium content of alloy 5 is within the permitted range (9.0% to 10.5% by weight), the cobalt content thereof is less than the lower limit, 52.5% by weight. Therefore, the alloy is high in coefficient of linear expansion and poor in resistance to corrosion as well. Similarly, in Comparative Example 5, although the chromium content of alloy 4 is within the permitted range, the cobalt content thereof exceeds the upper limit, 56.0% by weight. Therefore, the alloy is good in resistance to corrosion but unallowably large in coefficient of linear expansion.

In Comparative Example 7, although the cobalt content of alloy 6 is within the permitted range (52.5% to 56.0% by weight), the chromium content thereof is less than the lower limit, 9.0% by weight. The alloy therefore is poor in resistance to corrosion and unallowably large in coefficient of linear expansion as well. In Comparative Examples 8 and 9, although the cobalt contents of alloys 7 and 8 are within the permitted range, the chromium contents thereof exceed the upper limit, 10.5% by weight, respectively. Such alloys are good in resistance to corrosion but unallowably large in coefficient of linear expansion.

These results show that the object of the present invention can be accomplished, provided that alloys simultaneously contain 9.0% to 10.5% by weight of chromium and 52.5% to 56.0% by weight of cobalt.

Alloys and ceramics with a composition different from that restricted by the present invention, like Comparative Examples 10 to 15, were found not to fully satisfy both the resistance to corrosion and coefficient of linear expansion.

EXAMPLE 6 AND COMPARATIVE EXAMPLE 16

It was examined how working precision was affected by thermal distortion, when the slide hoppers were produced from the raw materials of the present invention.

About each block (thickness: 60 mm, length: 1 m) for the slide hopper, an amount of bending in the direction of thickness after milling was determined from measured deviation (mm) in the midpoint from the straight line joining both ends of the block in the direction of length. Conditions of cutting in milling (depth of cut×frequency) were as follows; 3 mm×one time, 1 mm×three times and 0.2 mm×three times.

Table 3 shows that the amount of bending of alloy 1 in Example 6 owing to the thermal distortion is reduced to one tenth or less, compared to that of SUS630 in Comparative Example 16. The amount of bending owing to the thermal distortion is further affected by polishing for finish of the raw materials which have already been cut, giving an effect on the working precision. As a result, finish with higher precision would be expected from alloy 1 in Example 6.

When the above-mentioned works are repeated, tools go out of use by milling chips cut into the tools or by breakage thereof. It has been confirmed that use of alloy 1 in Example 6 can extend the tools' lives twice or more, compared to use of SUS630 in Comparative Example 16.

TABLE 3

| | Raw Material | Composition (% by weight) | Coefficient of Linear Expansion | Amount of Bending Owing to thermal Distortion (mm) |
|---|---|---|---|---|
| Example 6 | Alloy 1 | Cr 9.3, Co 53.6, Fe | $0.6 \times 10^{-6}$ | 0.1 |
| Comparative Example 16 | SUS630 | Cr 17, Ni 4, Cu 4, Fe | $12.0 \times 10^{-6}$ | 1.1 |

The raw materials restricted by the present invention help to prevent the deflection in the lip owing to changes in temperature of the slide surface of the slide hopper stemming from coating with an organic solvent, maintaining the gap between the gap and the web with high precision. In addition, excellent cutting properties of the raw materials lead to highly precise production of the slide hopper. Therefore, the present invention makes it possible to form a thin layer by high-speed coating.

While the invention has been described in detail and with reference to specific embodiments thereof, it will be apparent to one skilled in the art that various changes and modifications can be made therein without departing from the spirit and scope thereof.

What is claimed is:

1. A method of bead coating a substrate comprising applying a coating solution comprising at least one component having a boiling point of 80° C. or less with a slide hopper composed of a raw material having a coefficient of linear expansion of $3\times10^{-6}$/°C. or less.

2. A method of bead coating a substrate comprising applying a coating solution comprising at least one component having a boiling point of 80° C. or less with a slide hopper composed of an alloy comprising 9.0% to 10.5% by weight of chromium, 52.5% to 56.0% by weight of cobalt and the remainder consisting essentially of iron.

3. An apparatus for bead coating a substrate with an organic solvent-based coating solution by the use of a slide hopper, wherein said slide hopper is composed of a raw material with a coefficient of linear expansion of $3\times10^{-6}$/°C. or less.

4. An apparatus for bead coating a substrate with an organic solvent-based coating solution by the use of a slide hopper, wherein said slide hopper is composed of an alloy comprising 9.0% to 10.5% by weight of chromium, 52.5% to 56.0% by weight of cobalt and the remainder consisting essentially of iron.

* * * * *